US008646768B2

(12) United States Patent
Kish et al.

(10) Patent No.: US 8,646,768 B2
(45) Date of Patent: Feb. 11, 2014

(54) QUICK SPIN HOLDER FOR TOOLS AND ACCESSORIES

(75) Inventors: Louis Kish, Santa Ana, CA (US); William Mathews, Woodstock, GA (US)

(73) Assignee: Python Safety, Inc., Woodstock, GA (US)

( * ) Notice: Subject to any disclaimer, the term of this patent is extended or adjusted under 35 U.S.C. 154(b) by 311 days.

(21) Appl. No.: 12/725,442

(22) Filed: Mar. 16, 2010

(65) Prior Publication Data

US 2010/0229347 A1 Sep. 16, 2010

Related U.S. Application Data

(60) Provisional application No. 61/160,482, filed on Mar. 16, 2009.

(51) Int. Cl.
*B23Q 3/00* (2006.01)
*A45F 5/00* (2006.01)

(52) U.S. Cl.
USPC ..... 269/287; 224/251

(58) Field of Classification Search
USPC ..... 254/134.3 FT; 24/3.1, 3.9; 224/251, 224/148.5; 269/287, 288; 401/38, 141
See application file for complete search history.

(56) References Cited

U.S. PATENT DOCUMENTS

| | | | | | |
|---|---|---|---|---|---|
| 245,257 | A | * | 8/1881 | Wright | 242/379 |
| 2,268,598 | A | * | 1/1942 | Kellems | 294/86.42 |
| 2,704,961 | A | * | 3/1955 | Weil | 351/157 |
| 3,909,886 | A | * | 10/1975 | Hocke | 24/122.6 |
| 4,432,663 | A | * | 2/1984 | Lasak et al. | 403/275 |
| 5,172,839 | A | * | 12/1992 | Frisbie | 224/251 |
| D424,826 | S | * | 5/2000 | Natuzzi et al. | D6/381 |
| 6,499,899 | B2 | * | 12/2002 | Sawyer | 401/131 |
| 7,270,289 | B2 | * | 9/2007 | Kish | 242/280 |

* cited by examiner

*Primary Examiner* — Lee D Wilson
*Assistant Examiner* — Jamal Daniel
(74) *Attorney, Agent, or Firm* — McClure, Qualey & Rodack, LLP

(57) ABSTRACT

A holder adapted to be attached to a tether to help retrieve a dropped tool or prevent a dropped tool from being lost or forgotten during use where the holder has a hollow member with an open end and a closed end and is adapted to frictionally hold a non-working end of a tool in the hollow member. The closed end of the hollow member has a centrally located opening within which is located a cylindrical member which is connected at one end to a shoulder connector and is coupled, either directly or indirectly, to an attachment means at its other end. The cylindrical member can be either fixed or rotatably coupled to the opening in the hollow member and the attachment means is configured to be attached to an end of a tether.

16 Claims, 1 Drawing Sheet

QUICK SPIN HOLDER FOR TOOLS AND ACCESSORIES

REFERENCE TO RELATED APPLICATIONS

This patent application claims the benefit of U.S. Provisional Application No. 61/160,482 filed on Mar. 16, 2009, the disclosure of which is incorporated herein in its entirety by reference.

BACKGROUND OF THE INVENTION

1. Field of the Invention

The present invention relates generally to a tethered tool holder and more specifically to a tool holder which can be made of a flexible material having good gripping power such as silicon rubber and which is adapted to be removably attached to a tool such as a screwdriver, at least one leg of a pair of pliers and to tools of various diameters, sizes and shapes or to an accessory where the tool holder can be tethered to a user's hand, clothing, or to a fixed member to prevent a dropped tool from being lost or forgotten during use. The tether can be connected at one or both ends with a quick release snap type rotatable connector which will allow the tool to turn/spin without winding the tether.

2. Description of Related Art

Different types of devices for preventing the accidental dropping and/or loss of a tool and a tool accessory is known in the prior art. More specifically, by way of example U.S. PreGrant Publication No. 2009/0276979 to Kauffman discloses a hand tool receiving apparatus which fits securely onto any hand tool and is attached, through the use of a center linkage assembly, to a wrist piece, which fits securely onto an operator's wrist.

U.S. Pat. No. 7,458,135 to Mikesell discloses a tether having an elastic member which provides an unstretched length having a first part and a second part with the first part of the unstretched length having less elastic resistance than a second part of the unstretched length to alter characteristics of stretch and recovery toward the unstretched length under load and unloaded conditions.

U.S. Pat. No. 7,343,647 to Kinskey discloses a device for holding and organizing items which includes an anchor for fastening the device to an object; a strap adapted to secure the items to the device; and a connector having an upper piece and a lower piece that pivot relative to one another where the upper piece is connected to the anchor and the lower piece is connected to the strap.

U.S. Pat. No. 7,124,470 to Alanis discloses a tool having a lanyard, a tool member and structures for attaching the lanyard and the tool member. The attaching structures include a pin that is attached to the lanyard and the tool member. The tool has a bore which is contiguous with an opening for receiving a pin. The opening is a slot and a pair of opposed first engaging surfaces which define the slot and engaging portions of a loop to maintain the pin within the slot and bore. A lanyard including a loop is received by the opening, where the loop defines an eyelet for receiving the pin to secure the lanyard to a tool.

U.S. Pat. No. 7,020,935 to Behn discloses a multiple item carrying device which allows a plurality of items to be carried, used and retrieved. The carrying device includes an adjustable main strap, a snap-fit closure along the length thereof, a mechanism at one end of the main strap to tether the device to a variety of locations, and a plurality of secondary straps at the other end for holding separate holders to which the items to be carried are secured.

U.S. Pat. No. 6,813,976 to Malvini discloses a hand tool tethering system for use with hand tools that includes a retractor adapted to be included in a housing of the hand tool, a tether attached to the hand tool's retractor mechanism at one end, and a coupling device at the opposite end for attachment to an operator or to a selected support structure. The retractor mechanism allows the tether to be movable between a stored position and a functional position.

U.S. Pat. No. 6,776,317 to Parker discloses a tool lanyard for releasable attachment to a safety harness of a workman to resiliently arrest the inadvertent dropping of a tool by the workman. The tool lanyard includes a looped cord on one end of the lanyard to receive a tool in a tightly gripped relation and a hook on an opposite end of the lanyard for mounting on a ring of the safety harness. A resilient connecting structure between the looped cord and the hook minimizes any shock action resulting from inadvertent dropping of the tool while arresting the dropping of the tool. The resilient connecting structure includes an outer non-elastic sheath about an inner elastic cord.

U.S. Pat. No. 6,530,131 to Hopkins discloses a tool leash device having at least one coiled leash having a closed loop at one end secured to a split key ring, a snap ring having a selectively opened and closed locking member secured to the split key ring for attachment to a belt loop or the like, a trigger snap connected to the other end of the coiled leash having a selectively opened and closed locking member for securing the same to a closed loop portion of a flexible tie wrap, and a flexible elongated tie wrap having a closed loop portion at one end connected to the trigger snap locking member at the other end.

U.S. Pat. No. 6,299,040 to Matias discloses a retaining device for attaching a chainsaw to a worker, working aloft. The retaining device provides a tear-away component between two sections of a lanyard. When the chainsaw is pinched in a falling limb, the slow, tearing motion of the tear-away component results in a minimal amount of impact force being exerted on a worker. In the event the tear-away component pulls apart entirely, the chainsaw is released from the worker and falls to the ground with the limb. The worker maintains his/her position within the structure. Alternatively, if the chainsaw is dropped by the worker, it will fall below the feet of the worker, allowing him/her to retrieve the chainsaw.

U.S. Pat. No. 6,216,319 to Elkins discloses a tool tether that includes an adjustable lanyard having a loop that fits over a user's hand that can be tightened. An opposite end of the lanyard from the loop includes a swivel clasping mechanism that can be connected to one of a plurality of hardware receptacles. The hardware receptacles include an eyelet or the like to allow it to be secured to the clasping mechanism. The hardware receptacles come in a wide variety of sizes to accommodate tools and hardware of different sizes and weights. In one embodiment, the hardware receptacles are cylindrically shaped rubber cups that are rigid enough to support different tools, and have different diameters. In an alternate embodiment, the hardware receptacles are flexible ring members that can be wrapped around a particular tool or component.

U.S. Pat. No. 6,029,321 to Fisher discloses a support strap for hand tools, hand guns and other hand-held implements having a pistol grip-type handle includes an elongated strip of flexible material having a ring attached to a first transverse end of the strip. A first fastener member is attached to the lower surface of the strip, near the second transverse end or tip of the strip, and a second fastener member which is releasably engageable with the first fastener member is attached to the upper surface of the strip. The strap is used by inserting the tip of the strap through the ring to form a first, wrist loop, into which loop the hand is inserted, and the free end pulled with a tension sufficient to tighten the loop to a desired tightness around the wrist of a user. The inner diameter of the loop is slightly less than the width of the strip to frictionally grip the edges of the strap. With the wrist loop of the strap attached to a person's wrist, the handle of a hand tool may be grasped and the tip of the strap pulled forward between the index finger and forefinger. The free end of the strap is then wrapped rearward around the handle to form a handle loop, around the thumb rearward of the rear joint of the thumb, and around the wrist to overlie the wrist loop. The free end is then pulled to tighten the handle loop. In an embodiment, the first fastener strip on the underside of the strip is a strip of VELCRO hook-type material, and the second fastener member is a length of VELCRO-type loop pile material that spans a substantial portion of the length of the upper surface of the strip.

U.S. Pat. No. 5,600,873 to May discloses a buoyant tether cords that remove ignition keys from personal watercraft to safely disable the motor in the event a rider falls off. When dropped in the water the cords float so that the ignition key is not lost. The cords float horizontally to maximize visibility. The cord has an elongated embodiment and a looped embodiment. Both have a brightly colored floating body that is attached to a stretchable, coil section. The coil enables the cord to elongate or contract. Both cords have one end to be coupled to the watercraft key, and an opposite end to be coupled to the rider. The floating body comprises an elongated, tubular foam core having an interior passageway.

U.S. Pat. No. 5,130,899 to Larkin discloses a tool restraint having an elongate elastomeric tether line, with a first and second flexible strap mounted to each end. The first web strap is attached an individual's wrist, with the second strap is attached to a tool member.

U.S. Pat. No. 5,082,156 to Braun discloses a tool wrist strap having a band, a looped cord and a clench bead on the cord. The band is made of a flexible elastic fabric material and formed by an elongated strip having opposite ends attached together. The band is adapted to fit loosely about a person's wrist. The looped cord is composed of flexible inelastic material and has a looped end portion and a pair of opposite ends attached to the band adjacent to one another. The clench bead is slidable on the looped cord and produces sufficient friction to hold the bead in any given position along the cord. The bead can be slidably moved by a person's hand in opposing directions away from and toward the looped end portion of the cord for untightening and tightening the looped end portion in a noose-like configuration about a portion of a tool.

SUMMARY OF THE INVENTION

In an exemplary embodiment of the present invention, there is disclosed a holder adapted to be attached to a tether to help retrieve a dropped tool or prevent a dropped tool from being lost or forgotten during use, the holder comprising:

- a hollow member having an open end and a closed end adapted to receive a non-working end of a tool which is inserted into the open end of the hollow member;
- a centrally located opening in the closed end of the hollow member;
- a shoulder connector having a cylindrical member located in the centrally located opening in the closed end of the hollow member; and
- attachment means coupled to the cylindrical member;
- wherein the attachment means is configured to be attached to an end of a tether.

In another embodiment of the present invention, there is disclosed a method of preventing a dropped tool from being lost or forgotten during use comprises:

- providing a hollow member having an open end and a closed end adapted to receive a non-working end of a tool located in the open end of the hollow member;
- locating an opening in the center of the closed end of the hollow member;
- providing a shoulder connector having a cylindrical member located in the opening in the closed end of the hollow member; and
- connecting an attachment means to the cylindrical member;
- wherein the attachment means is configured to be attached to an end of a tether.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

When working on machines which are located in confined areas such as in the interior of an airplane, an airplane engine or inside a submarine, the possibility of dropping a hand tool such as a wrench, a screw driver or a tool designed for a specific job, can result in a waste of time and inconvenience in retrieving the tool. In some instances such as in a jet engine, a loose or lost tool that is not retrieved may be a potential hazard to the safe operation of that engine and the airplane with that engine.

Thus, it is important that a person using a hand tool, a pencil, a small flashlight or other hand held tool makes sure that the hand held tool is not lost or left inside the work area. This is very important when the user of the tool is working in a confined area or where the area where the work is being performed is very sensitive to the presence of a foreign object such as, for example in a power plant, an aircraft, a submarine, etc. This invention is directed towards an apparatus that, when attached to a tool, will allow a person to retain control over the tool while it is being used without fear that a dropped tool will be lost or left behind.

Figure 1:
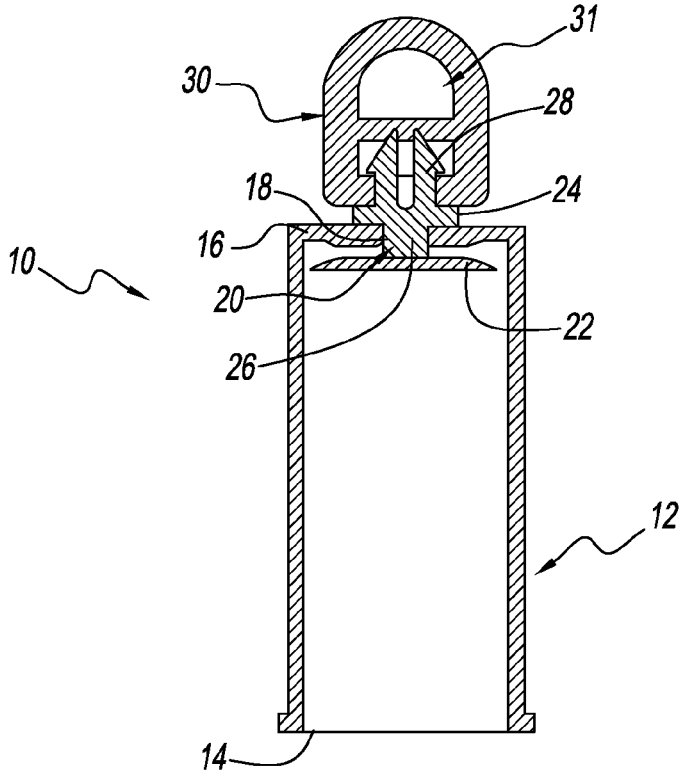
FIG. 1 is a side sectional view of a tool holder adapted to be removably attached to a tool and which can be tethered to a person or a fixed member to prevent accidental dropping or loss of the tool in accordance with the principles of the invention.

Referring to FIG. 1, there is shown a side sectional view of a tool holder adapted to be removably attached to a tool and which can be tethered to a person or a fixed member to prevent accidental loss of the tool. The tool holder 10 consists of a hollow cylindrical or funnel shaped member 12 which is made of rubber or a flexible plastic. One end 14 of the hollow cylindrical member 12 is open and the other end 16 is closed. Hollow cylindrical member is configured to be pushed over and frictionally grip the non-working end or handle of a tool such as, for example, a screw driver, a socket wrench, etc. Member 12 is sufficiently flexible to conform to the shape of the handle of the tool so that the tool is securely held by frictional forces between the inside wall of the hollow cylindrical member and the handle of the tool. If desired, the inside surface of the cylindrical member can have a rough surface or a soft release adhesive which can be applied to the inside surface of hollow cylindrical member to help increase the frictional force between the member 12 and the handle of the tool in member 12.

The closed end 16 of the hollow cylindrical member has a centrally located opening 18. A shoulder connector 20 has a lower disk shaped member 22, an upper disk shaped member 24 and a cylindrical member 26 located between and connected to the lower and upper disk shaped members. Lower disk shaped member has a diameter that is slightly less than the inside diameter of the hollow cylindrical member and a rib around the circumference (not shown) of the lower disc which cooperates with the corresponding groove shown around the circumference or the closed end 16. The upper disk shaped member 24 has a diameter that is less than the diameter of the hollow cylindrical member 12 and larger than the diameter of the opening 18 in the closed end of the hollow cylindrical member 12. Cylindrical member 26 has a length that is slightly greater than the thickness of closed end 16 of the hollow cylindrical member and a diameter that is slightly less than the diameter of opening 18. Cylindrical member 26, which is located between and is securely connected to both the upper and lower disk shaped members is rotatably located in opening 18. Lower member 22 and/or upper member 24 can have burrs which contact and rub against the surface(s) of closed end 16 of the hollow cylindrical or funnel shaped member to provide mechanical rotational resistance to shoulder connector 20.

Connected to and extending out from the top surface of the upper disk shaped member 24 is a split shaft 28 having two protrusions on its end which extend substantially perpendicular to the longitudinal axis of the shaft to form a spring snap fitting. Spring snap fitting is rotatably located in a circular opening in the base of a spinner connector 30 having at its top a loop 31 adapted to be connected either directly or indirectly to one end of a string, strap, stretch cord or other flexible member. Spinner connector can freely rotate about the split shaft but cannot be easily pulled apart from the split shaft. The other end of the string, strap, stretch cord or flexible member may be secured to, or be a part of a connection to the person using the invention where the connection can be a strap, belt, retracting device, lanyard, a fixed member or other common connecting device.

In another embodiment of the invention the hollow cylindrical or funnel shaped holder is fixed to connector 30. This embodiment is possible because the hollow cylindrical or funnel shaped holder is connected to a person or a fixed member with a flexible member such as a strap, string, belt, etc. which can be bent and twisted, and is not stiff and rigid.

In use, a person working in a confined area where a lost or forgotten tool can create a problem starts work by inserting a specific tool that is to be used into the hollow cylindrical or funnel shaped member 12 which captures and securely locks onto the tool. The person now connects one end of a string, strap, elastic line or other flexible member to connector 30, which, in this embodiment can be a spinner connector, and connects the other end of the string, strap, elastic line or other flexible member to a strap, belt, retracting device, lanyard, a fixed member, or any other common connecting device, and then starts to do his/her assigned task knowing that no tool will be lost or left behind.

Figure 2:
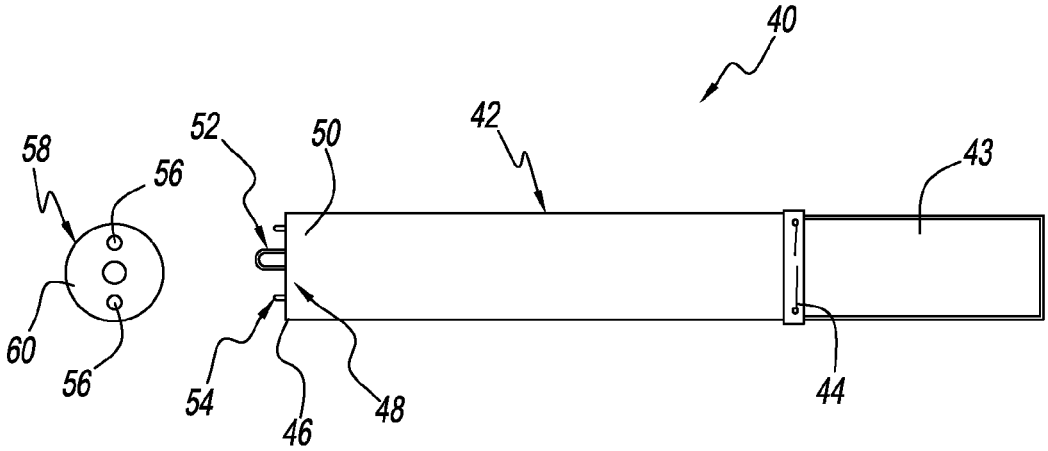
FIG. 2 is a partially exploded side sectional view of another embodiment of a tool holder adapted to be removably attached to a tool such as a pen or other small item and which can be tethered to a person or a fixed member to prevent accidental dropping or loss of the tool in accordance with the principles of the invention.

Referring to FIG. 2, there is shown a partially exploded side sectional view of another embodiment of a tool holder adapted to be removably attached to a tool such as a pen or other small item and which can be tethered to a person or a fixed member to prevent accidental loss of the tool in accordance with the principles of the invention.

Tool holder 40 consists of a small diameter hollow cylindrical or funnel shaped member 42 which is made of rubber or a flexible plastic for holding a pen, pencil, small screw driver, small pen flash light 43, etc. One end 44 of hollow cylindrical member 42 is open and the other end 46 is closed. Hollow cylindrical member is configured to be pushed over a small diameter non-working end of the small tool. Member 42 is sized to receive and securely hold the small tool with frictional forces between the inside wall of the hollow cylindrical member and the small tool. If desired, the inside surface of the cylindrical member can have a rough surface or a soft release adhesive which is applied to the inside surface of hollow cylindrical member to help increase the frictional force between the member 42 and the small tool located within member 42.

Closed end 46 of the hollow cylindrical member has a centrally located opening (not shown). A shoulder connector 48 having a lower disk shaped member 50, and a centrally located cylindrical member 52 that projects outward. Lower disk shaped member has a diameter that is slightly less than the inside diameter of the hollow cylindrical member and cylindrical member 52 has a length that is one-quarter to one-half of an inch greater than the thickness of the closed end 16 of the hollow cylindrical member and a diameter that is slightly greater or less than the diameter of the opening in the closed end. Cylindrical member 52 is securely connected to the lower disk shaped member and may be either rotatably located or press fit into the opening in the closed end.

Projecting out from and securely attached to the top surface of the closed end 46 are two protrusions 54 which are adapted to be located in two openings 56 in retaining ring 58 which has a centrally located opening 60 that is adapted to receive cylindrical member 52. The protrusions may be mechanically shaped and heat staked, riveted, etc to closed end 46. The protrusions 54 and the cylindrical member may be connected to the retaining ring 58 by mechanical means with, for example a snap, weld or press fit.

The end of cylindrical member 52 that extends out from retaining ring 58 can now be connected to one of several configurations that either spins, swivels or is fixed and has a loop opening which can be attached, either directly or indirectly, to an end of a flexible member such as a string, strap, cable, stretch cord, etc. The other end of the string, strap, cable, stretch cord or other flexible member may be secured to, or be a part of a connection to a person using the invention.

In use, a person working in a confined area where a dropped or lost tool can create a problem inserts a specific tool such as a pen or a pen type flash light into the hollow cylindrical shaped member 42 which captures and securely locks onto the tool. The person now connects one end of a string, strap, elastic line or other flexible member to the connector which is attached to the end of the cylindrical member 52, and connects the other end of the string, strap, elastic line or other flexible member to a strap, belt, retracting device, lanyard, a fixed member, or any other common connecting device, and then starts to do his/her assigned task knowing that a tool will not be lost or left behind.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A holder adapted to be attached to a tether to help retrieve a dropped tool or prevent a dropped tool from being lost or forgotten during use, the holder comprising:

a cylindrical hollow member made of a yieldable flexible material, having an open end and a closed end adapted to receive a non-working end of a tool which is inserted into the open end of the cylindrical hollow member, wherein a wall of the cylindrical hollow member conforms to the shape of the non-working end of the tool and frictionally engages and grips the non-working end of the tool located in the cylindrical hollow member;

a centrally located opening in the closed end of the cylindrical hollow member;

a shoulder connector having:

a lower disk shaped member;

an upper disk shaped member; and a cylindrical member located between and connected to the lower and upper disk shaped members and located in the centrally located opening in the closed end of the hollow member; and attachment means coupled to the cylindrical member;

wherein the attachment means is configured to be attached to an end of a tether.

2. The holder of claim 1 wherein the cylindrical hollow member is made of rubber or a plastic.

3. The holder of claim 2 wherein the attachment means has a loop or an opening for receiving an end of a tether.

4. The holder of claim 3 wherein the attachment means is rotatably coupled to the cylindrical member.

5. The holder of claim 3 wherein the attachment means is securely attached to the cylindrical member.

6. The holder of claim 3 wherein the attachment means is swiveling coupled to the cylindrical member.

7. The holder of claim 4 wherein the cylindrical hollow member has a chamber that has a diameter and depth which is sufficient to receive a specific tool such as a wrench, a screw driver, or a pen.

8. The holder of claim 3 wherein the attachment means has a loop or an opening for receiving an end of a flexible tether.

9. A method of preventing a dropped tool from being lost or forgotten during use comprising:

providing a cylindrical hollow member made of a yieldable flexible material, having an open end and a closed end adapted to receive a non-working end of a tool located in the open end of the cylindrical hollow member; locating an opening in the center of the closed end of the cylindrical hollow member, wherein a wall of the cylindrical hollow member conforms to the shape of the non-working end of the tool and frictionally engages and grips the non-working end of the tool located in the cylindrical hollow member;

providing a shoulder connector having:

a lower disk shaped member;

an upper disk shaped member; and a cylindrical member located between and connected to the lower and upper disk shaped members and located in the opening in the closed end of the cylindrical hollow member; and connecting an attachment means to the cylindrical member;

wherein the attachment means is configured to be attached to an end of a tether.

10. The method of claim 9 wherein the cylindrical hollow member is made of rubber or a plastic.

11. The method of claim 10 wherein the attachment means has a loop or an opening for receiving an end of a tether.

12. The method of claim 11 wherein the attachment means is rotatably coupled to the cylindrical member.

13. The method of claim 11 wherein the attachment means is securely attached to the cylindrical member.

14. The method of claim 11 wherein the attachment means is swiveling coupled to the cylindrical member.

15. The method of claim 12 wherein the cylindrical hollow member has a chamber that has a diameter and depth which is sufficient to receive a specific tool such as a wrench, a screw driver, or a pen.

16. The method of claim 11 wherein the attachment means has a loop or an opening for receiving an end of a flexible tether.

* * * * *